United States Patent [19]

Saikatsu et al.

[11] Patent Number: 4,461,981

[45] Date of Patent: Jul. 24, 1984

[54] LOW PRESSURE INERT GAS DISCHARGE DEVICE

[75] Inventors: Takeo Saikatsu; Yoshinori Anzai; Toshiro Kajiwara; Goroku Kobayashi; Shunichi Morimoto, all of Kamakura, Japan

[73] Assignee: Mitsubishi Denki Kabushiki Kaisha, Tokyo, Japan

[21] Appl. No.: 451,230

[22] Filed: Dec. 20, 1982

[30] Foreign Application Priority Data

| | | | |
|---|---|---|---|
| Dec. 26, 1981 | [JP] | Japan | 56-212479 |
| Jan. 11, 1982 | [JP] | Japan | 57-2476 |
| Jan. 11, 1982 | [JP] | Japan | 57-2477 |
| Mar. 30, 1982 | [JP] | Japan | 57-51845 |

[51] Int. Cl.[3] ..... H01J 61/16; H05B 41/24

[52] U.S. Cl. ..... 315/246; 313/553; 313/572; 313/643; 315/358

[58] Field of Search ..... 315/246, 358; 313/553, 313/572, 643

[56] References Cited

U.S. PATENT DOCUMENTS

| | | | |
|---|---|---|---|
| 2,671,184 | 3/1954 | Kenty | 313/572 X |
| 2,874,324 | 2/1959 | Klepp et al. | 313/572 |
| 3,814,971 | 6/1974 | Bhattacharya | 313/643 |
| 4,032,813 | 6/1977 | Shurgan et al. | 313/643 X |

*Primary Examiner*—Eugene R. LaRoche

*Attorney, Agent, or Firm*—Sughrue, Mion, Zinn, Macpeak and Seas

[57] ABSTRACT

A lamp primarily containing neon gas is supplied with alternating electrical power at a frequency of not less than 5 kHz. The discharge current is determined on the basis of the gas pressure such that no striations occur. If necessary, getter means including a metal element belonging to the second, third, fourth or fifth periodic group are provided near each electrode, oriented so as not to interfere with any electron emissions from the lamp electrodes.

21 Claims, 5 Drawing Figures

LOW PRESSURE INERT GAS DISCHARGE DEVICE

BACKGROUND OF THE INVENTION

1. Field of the Invention

This invention relates in general to a low pressure inert gas discharge device and to a method of operating same, and more particularly to one in which the luminescence of neon is utilized.

2. Description of the Prior Art

A low pressure inert gas discharge lamp utilizing the luminescence of a positive column has numerous advantages such as less deterioration, longer life, less temperature dependence, and less flux variation after startup, in comparison with a fluorescent lamp.

As neon emits red light, it is suitable as a light source in a facsimile machine or in an optical character reader where a red light source is utilized.

It is well known that there is flickering, commonly termed moving striations, in the positive column of a low pressure inert gas. Such striations depend upon the value of the discharge current; there are upper and lower limits for the discharge current which cause the striations to occur. Consequently, it is required that the value of the discharge current be below the lower limit or above the upper one in order to obtain a stabilized discharge with no striations.

Usually a discharge current whose value is below the lower limit will not produce sufficient light output because of its small value and is thus of no practical use, whereby it is required that the value of the discharge current be above the upper limit.

This upper limit is established by the following formula, called Pupp's critical current:

$$Ic=c/p,$$

wherein:

Ic=critical current, c=constant value peculiar to a given inert gas, and p=gas pressure (Torr).

The above formula has been further developed by Rutscher and Wojaczek, as follows:

$$Ic=c/p\gamma,$$

wherein:

$\gamma$=an additional constant value peculiar to a given inert gas.

For neon, c=7 and $\gamma=1$.

These formulae have been derived from direct current discharge, and are therefore not applicable to alternating current discharge because the current value so determined may be above the upper limit at a certain moment and less than such limit at another moment.

It is thus difficult to determine the upper and lower limits for critical currents in an alternating current discharge mode. With respect to a high frequency discharge, however, as the alternating speed of the electrical polarity of a discharge current is higher than the speed of ambipolar diffusion, the ion density does not vary in accordance with the alternation of the polarity of the discharge current; in other words, the ion density is almost constant. Therefore, critical lower and upper current limits can be established.

The value of the critical current depends upon the gas pressure, which is determined in consideration of luminous efficiency and life, while it is required that the value of the discharge current be more than that of the upper critical current limit.

The design of a lamp, a lighting apparatus, or a range where a lamp is applicable is limited by the critical current. It is thus desirable to reduce the value of the critical current in order to minimize this limitation.

Among low pressure gas discharge lamps where the luminescence of an inert gas is utilized, gaseous impurities which have an undesirable effect on emitting light, starting, and lighting are minimized using getters. The impure gas contained in such a lamp would cause the lamp to start with difficulty. If the impure gas contains an atom or a molecule whose excitation potential is lower than that of that of the inert gas, the energy supplied to the lamp is first consumed by such an atom or molecule. Light which is unnecessary or undesirable is then emitted, and subsequently the lamp becomes poor in both its colorimetric purity and its efficiency. For example, an energy of about 19 ($e\bar{v}$) is needed for a low pressure neon discharge lamp to emit red light at a wave length of 640 (nm). If a molecule of nitrogen (the resonance excitation potential for N2 is 1.6 ($e\bar{v}$) and that for N is 10.2 ($e\bar{v}$)), of oxygen (the resonance excitation potential for 0 is 9.1 ($e\bar{v}$)) or of hydrogen (a resonance excitation for H is 12.2 ($e\bar{v}$)) is contained in the lamp as an impure gas, an energy of about 13 ($e\bar{v}$) is sufficient for such an impure gas to emit light. Consequently, the light emitted from such an impure gas and that emitted from the neon gas mix with each other. Under these circumstances, a red light emitting neon lamp which has both excellent colorimetric purity and a high efficiency cannot be obtained. Additionally, an impure gas which is produced in correspondence to the consumption of the cathode material causes the discharge to be unstable and reduces the life of the lamp.

SUMMARY OF THE INVENTION

An object of this invention is to provide a low pressure inert gas discharge device having a discharge lamp containing neon as its major gas, which can be steadily lighted, and a method of operating such a device.

This object is achieved by a device comprising a lamp having a bulb in which inert gas mostly composed of neon is sealed at a pressure ranging from 1.5 to 15 Torr, an electrode structure contained in the said bulb, and means for supplying said lamp with electrical power at a frequency of not less than 5 kHz, wherein the peak value Iop (A) of the electrical current and the pressure P (Torr) of the sealed insert gas satisfy the following formulae:

$$\text{when } 1.5 \leqq P \leqq 8,\ Iop \geqq 7/P^{1.1},$$

and $$\text{when } 8 < P \leqq 15,\ Iop \geqq 69/P^{2.2}.$$

Another object of this invention is to provide such a lamp which can start lighting at a low starting voltage with a high reliability, which can emit light with an excellent colorimetric purity, and which has a long life.

This object is achieved by providing getter means for each electrode having a metal component chosen from the group consisting of metal belonging to the second, third, fourth or fifth periodic groups with a getter function, except at the portion of each electrode where an electron emitting substance is attached.

DETAILED DESCRIPTION OF THE PREFERRED EMBODIMENTS

Figure 1:
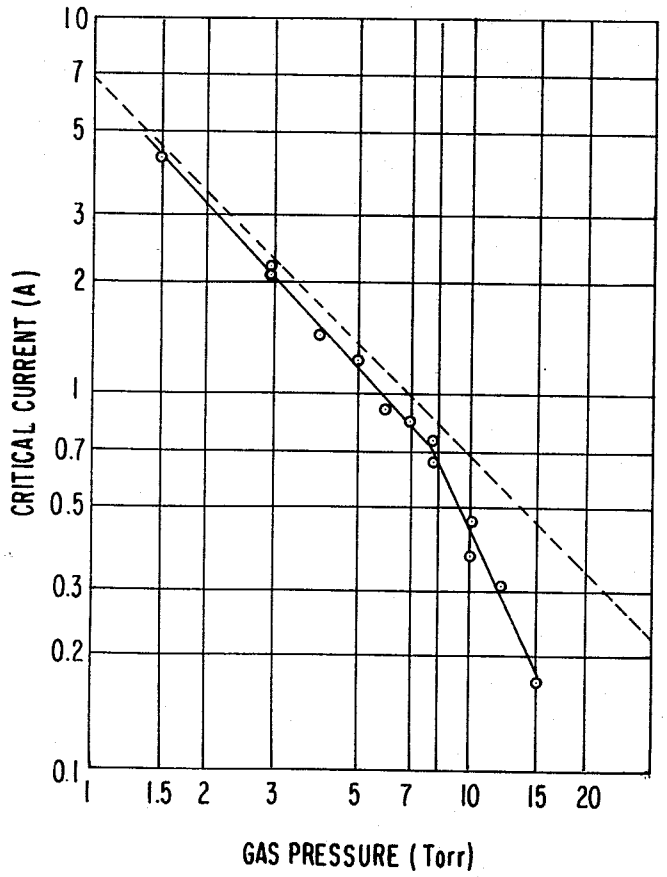
FIG. 1 is a chart showing the results of experiments concerning the relation between the critical current and the pressure of neon gas in an embodiment of this invention.

Various embodiments of this invention are described below, referring to the drawings and based on the results of experiments by the applicants. First, with respect to the equipment used in the experiments, some brief descriptions will be given.

The lamps used contained filament coil electrodes sealed at both end portions, neon gas at a pressure ranging from 1.5 to 15 Torr, and comprised glass tubes which were 26 mm in diameter and 436 mm in length. A high frequency electrical power supply was utilized in order to drive the lamps. A current limiting element having an appropriate impedance was inserted between the power supply and each lamp, namely a leakage type of output transformer.

In order to determine the critical current, waveforms of emitted light for various values of discharge current were detected by a photodiode, and the current value at which uniform and stable light was emitted throughout the positive column was recorded.

Since the lamp, the high frequency power supply and the leakage transformer which were used in the experiments were conventional, a detailed disclosure thereof will not be given.

The results of the experiments shown in FIG. 1 are concerned with the relation between the critical current and the pressure of the sealed gas. In FIG. 1 the abscissa shows the pressure, and the ordinate shows the critical current on a logarithmic scale. The small circles designate experimental values which the bent solid line follows. The peak value of the current corresponds to the critical value in FIG. 1. The dotted line corresponds to the equation $Ic=7/p$ ($Ic$=critical current, $p$=pressure) as established by Rutscher and Wojaczek for a direct current discharge in neon.

The solid line showing the relation between the critical current and the pressure is approximately described as follows:

$Ic=7/p^{1.1}$ wherein the pressure of the sealed gas is below 8 Torr, and $Ic=69/p^{2.2}$ wherein the pressure of the sealed gas is above 8 Torr.

FIG. 1 thus shows that the dotted line corresponding to a direct current discharge and the solid line corresponding to a high frequency current discharge are close to each other at low pressures, while the difference between these two lines becomes larger as the pressure increases. The reason for this is not clear, but it might be because the differences between a high frequency discharge and a direct current discharge have some effect not accounted for in the equation by Rutscher and Wojaczek, which is based on experiments where the gas pressure was relatively low.

Applicants also have researched the case where the starting voltage for the lamp discharge is reduced owing to the Penning effect. It is well known that the Penning effect can be found in neon which includes traces of argon, krypton or xenon. As the critical current for argon, krypton or xenon is different from that for neon, the value of the critical current for neon mixed with such a gas is also different from that for a pure neon gas. More of such gas contained in the neon causes the value of the critical current to be larger, and the Penning effect is most notable when the neon gas contains such other gas in a range of 0.1 to 1 percent by volume. A mixture ratio of at most one percent of neon with argon, krypton of xenon is thus sufficient for the Penning effect. In this regard, applicants have studied lamps whose mechanical structures were the same as those described above, which contained 99% neon gas as a major gas and one of argon, krypton or xenon at 1% as a residual minor gas at a total or combined pressure ranging from 1.5 to 15 Torr.

The results of the experiments where the above lamps were used show that the value of the critical current in the lamps containing such minor amounts of argon, krypton or xenon is smaller than in lamps containing neon only.

In conclusion, it has been made clear that, in lamps where the Penning effect is utilized, lighting the lamp at a current whose value is not less than that of the critical current for a lamp containing neon only enables a stabilized discharge having no striations.

Generally speaking, a fluctuation in the electron density may occur at a low lighting frequency whose lower limit has not yet been clarified.

The value of the critical current is constant when the lighting frequency is not less than 5 kHz.

The reasons why the value of the critical current is expressed as a peak value is that in experiments where sinusoidal high frequency electric power was applied to the lamp, current distortion sometimes occurred because of electrode damage, for example. The peak values of the critical current were always constant, however.

Directing attention to the constancy in the peak value, applicants conducted experiments where the shape of the high frequency electric power was a square wave. It was found that the value of the critical current was almost the same as the peak value of the critical current for sinusoidal high frequency electrical power signals. The reason for this fact may be that the electron density is affected by the peak value of the current rather than by the root-mean-square value of the current.

The pressure of the gas contained in the lamp is determined based on the following reasoning. A pressure which is below 1.5 Torr requires too large a critical current, which reduces the life of the lamp. A pressure which is above 15 Torr is also not suitable because the luminescence efficiency becomes lower as the pressure becomes higher.

Figure 2:
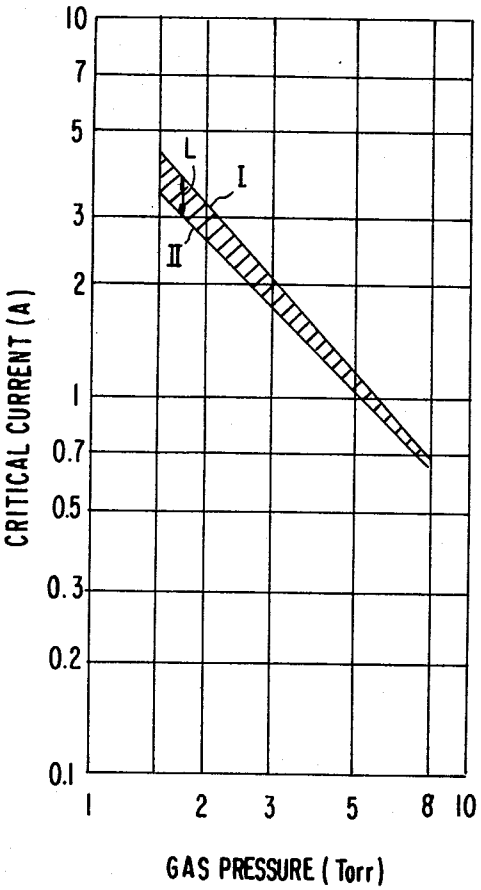
FIG. 2 is a similar chart showing the results of experiments for a neon-argon mixed gas.

Another embodiment of this invention is described using FIG. 2, which relates to a discharge lamp where neon gas is mixed with argon, krypton or xenon. Before a detailed description of this embodiment, a general description of a lamp which contains two mixed inert gases will be given.

In general, the critical current for striations in gas depends upon the kind of gas, and it is supposed that a mixture of two inert gases has a critical current whose value is between those of the two individual gases.

Argon, krypton, and xenon have critical current values which are smaller than that of neon. These inert gases have ionization potentials which are lower than that of neon, and consequently when one of them is mixed with neon it emits light before the neon. Thus, the amount of argon, krypton or neon which may be added to a lamp containing neon is extremely limited.

With respect to a low pressure inert gas discharge lamp containing a mixture of neon and argon, the condition where the neon emits most of the light is described in Japanese patent application No. 56-167502 in relation to the pressure of the sealed gas and the ratio of the mixture, as below:

$$A \leqq 5P^{-2},$$

where:

P=the pressure of the sealed gas (Torr), and

A=the mixture ratio for argon (%).

The mechanical structure of the lamp in this embodiment is the same as that in the first embodiment. The lamp in this embodiment contains neon-argon mixed gas, in a pressure range of 1.5 to 8 Torr, and the relation between the pressure and the mixture ratio is given by the above formula.

The relation between the critical current and the pressure of the sealed gas based upon the results of experiments is shown in FIG. 2, where the shadowed portion indicates the region in which the values of the critical current lie.

The upper straight line I in FIG. 2 shows the relation when the lamp contains only neon, and it corresponds to the left portion of the solid line in FIG. 1.

The vertical difference L between lines I and II indicates the amount of reduction in the value of the critical current, which is given by the following formula:

$$5.3\,p \leqq Ic \leqq 7/P^{1.1}$$

at the region $1.5 \leqq P \leqq 8$, wherein:

P=the pressure of the sealed gas (Torr), and

Ic=the value of the critical current (A).

Similar to the first embodiment, the lower limit of the lighting frequency where the value of the critical current varies is not certain, but a frequency which is not less than 5 kHz does not induce any variations in the value of the critical current. In FIG. 2 the value of the critical current indicates the peak value of the current, similar to that in the first embodiment.

The reason why the pressure of the sealed gas is selected in a range of 1.5 to 8 Torr is that the lower the pressure, the larger the value of the critical current. Consequently, lower pressures reduce the life of the lamp.

When the pressure is above 8 Torr, the critical current becomes close to that in a lamp containing only neon, and its value is quite small. Consequently, in this case it is unnecessary to reduce the value of the critical current.

Another embodiment of this invention is described below, which relates to a lamp containing neon as a major component and krypton as a minor one.

With such a low pressure inert gas discharge lamp, the condition where the neon emits most of the light is described in Japanese patent application No. 56-167503 in relation to the pressure of the sealed gas and the mixture ratio, as below:

$$A \leqq 8P^{-2}$$

wherein:

P=the pressure of the sealed gas (Torr), and

A=the mixture ratio for krypton (%).

The lamps in this embodiment contain neon-krypton mixed gas at a pressure range of 1.5 to 8 Torr, in which the relation between the pressure and the mixture ratio is given by the above formula.

Figure 3:
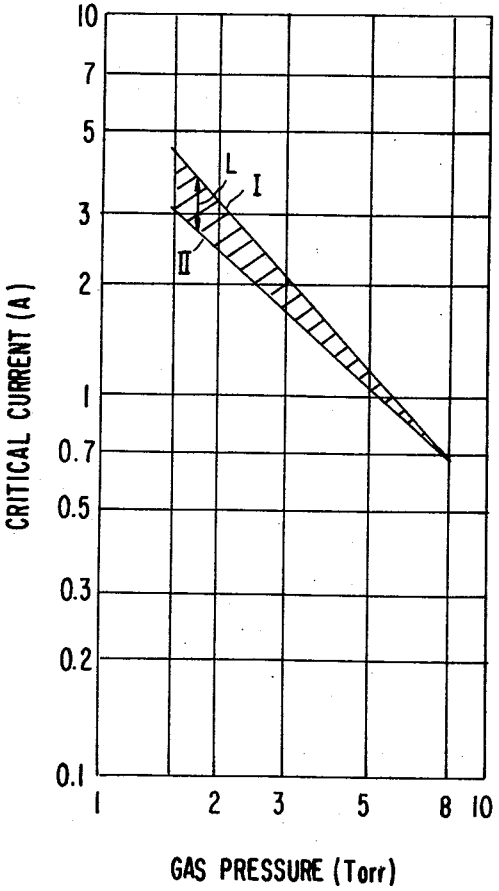
FIG. 3 is a similar chart showing the results of experiments for a neon-krypton mixed gas.

The relation between the critical current and the pressure of the sealed gas based on the results of experiments is shown in FIG. 3, where the shadowed portion indicates the region in which the values of the critical current lie.

FIG. 3 shows that the reduction in the value of the critical current is given by the following formula:

$$4.5/P^{0.9} \leqq Ic \leqq 7/P^{1.1} \text{ when } 1.5 \leqq P \leqq 8,$$

wherein:

P=the pressure of the sealed gas (Torr), and

Ic=the value of the critical current (A).

Similar to the first and second embodiments, the lower limit of the lighting frequency where the value of the critical current varies is not certain, but a frequency which is not less than 5 kHz does not induce any variations in the value of the critical current. In FIG. 3 the value of the critical current indicates the peak value of the current, similar to the first and second embodiments.

The reason why the pressure of the sealed gas is selected in a range of 1.5 to 8 Torr is similar to that of the FIG. 2 embodiment.

Figure 4:
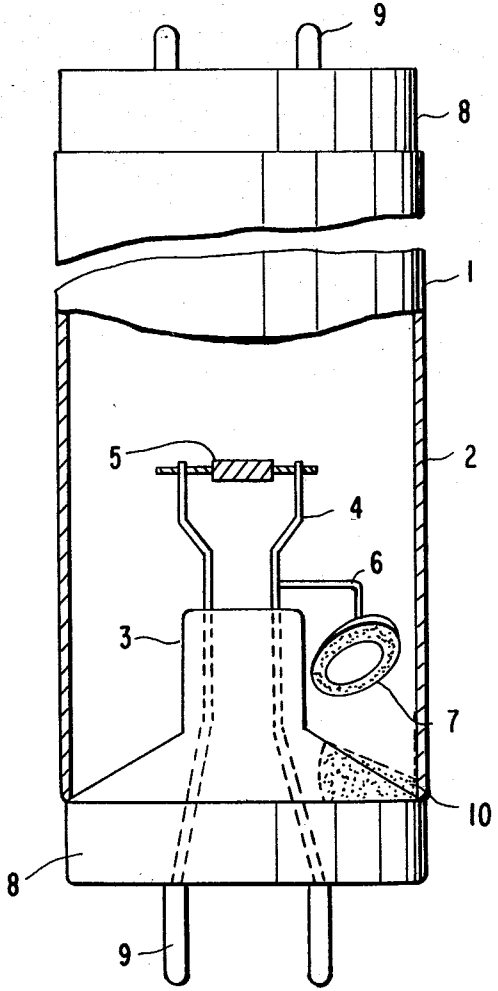
FIG. 4 is a partial cross-sectional view showing an embodiment of a lamp which is applicable to this invention.

The following embodiments relate to the structure of the discharge lamp in general, and more particularly to the arrangement of getters which avoid the luminescence of gaseous impurities and undesirable effects on the starting or life of the lamp. As shown in FIG. 4 an inert discharge lamp 1 comprises an elongate glass bulb 2 having no coatings on its inner surface, and a stem 3 which is tightly bonded at the end of the bulb. Two electrode supports 4 whose ends mount a preheating electrode 5 are attached to the stem 3. One of the electrode supports also mounts a getter holder 6 to which a metal getter structure 7 is secured containing one or more getters belonging to the second, third, fourth or fifth group near the preheating electrode 5.

Where a the flash getter such as barium (Ba) or magnesium (Mg) is used, it is desirable that the getter emission surface should face in a direction opposite to the electrode 5 in order to prevent the getter emissions or sputterings from having an undesirable effect on the electrode. The lamp 1 is equipped with a similar getter structure and preheating electrode at its other end.

The electrode supports 4 pass through the stem 3 and connect electrically to pins 9 of a lamp base 8. In manufacturing such a lamp containing a getter, where a non-vaporizable metal or an alloy belonging to the second, third, fourth, or fifth group such as thorium (Th), titanium (Ti), zirconium (Zr), or tantalum (Ta) is used, it is important and desirable to heat the lamp sufficiently to exhaust the unwanted gas by fully activating the getter material.

Where a flash getter is used, it is desirable to heat the getter emitting structure 7, for example by high frequency induction heating to flash the barium metal which is a major component of the getter. The getter material is thereby sputter coated onto the device over a region which covers an inner wall of the end portion of the glass bulb 2 and the edge of the stem 3, as indicated by reference numeral 10 in FIG. 4.

In a lamp equipped with plural preheating electrodes, a sufficient effect cannot be obtained by adsorbing an impure gas contained in the lamp by means of one getter structure located near the electrode. As the preheating electrodes gradually consume themselves they emit or evolve impure gases, which if close to the electrode will reduce or hinder its capability for emitting electrons. This shortens the life of the lamp and impedes the switchover from a glow discharge to an arc discharge on startup.

Consequently, it is necessary to remove the impure gas which has evolved as quickly as possible. This embodiment resolves not only the problem of striations but also the problem of impure gas evolving from the electrodes.

The results of experiments by applicants are shown below. The lamps contained neon gas at a pressure of 4 Torr, and were 25 mm in diameter and 436 mm long. These dimensions are those of an FL 15 type of fluorescent lamp.

Two kinds of lamps were used in the experiments. One was equipped with getters near the electrodes, the other had no getters.

The getter structure 7 in FIG. 4 comprises a barium-aluminum alloy buried in a groove on an iron base shaped like a doughnut, is clad with nickel, and contains barium at a ratio of 55 percent. The getter structure was heated to a temperature of about 1100° C. by high frequency induction heating so that the getter flashed and was thereby sputter coated over a region excluding the electrode 5.

Experiments were performed in which the lamps were equipped with various amounts of getter material to the same amount of cathode substance. The results of the experiments show that a lamp equipped with no getter needs a high lighting voltage of 150 ($\bar{v}$) and emits light which includes other than neon red in its spectrum, which is not desirable in terms of light purity. On the other hand, the lamp equipped with a getter functioned at a low voltage of 100 ($\bar{v}$), which is the usual voltage for a common FL 15 type of lamp, and emitted pure red light peculiar to neon.

In these lamps, the life of the lamp depends upon whether the getters are located near either one or both electrodes, and upon the amount of the getter, as is clear from Table 1 below. In Table 1, the amount of the getter means the ratio of the getter substance to the cathode substance of each electrode.

TABLE 1

| Lamp No. | Location of the getter structure | Amount of getters in each getter structure (ratio) | Life Hours |
|---|---|---|---|
| 1 | None | | 85 |
| 2 | at one electrode | 1/25 | 400 |
| 3 | at one electrode | 1/5 | 700 |
| 4 | at both electrodes | 1/25 | 1,200 |
| 5 | at both electrodes | 1/5 | not less than 2,000 |
| 6 | at both electrodes | 1/2 | not less than 2,000 |

As is shown by Table 1, the life of a lamp equipped with no getter structure or with one getter structure nearly only one electrode is much shorter than that of a lamp which is equpped with a getter structure near each electrode.

These experiments confirm that an amount of getter which is not less than one twentieth of that of the cathode substance in an electrode is needed to ensure a lamp life beyond two thousand hours; otherwise an impure gas such as oxygen would gradually evolve in correspondence to the consumption of the cathode substance and would saturate the capability of the getter. That is, it would reduce the capability of electron emission or establish a light spot which would emit electrons on restriking, and consequently a direct current component would be produced in the discharge which would shorten the life of the lamp.

Figure 5:
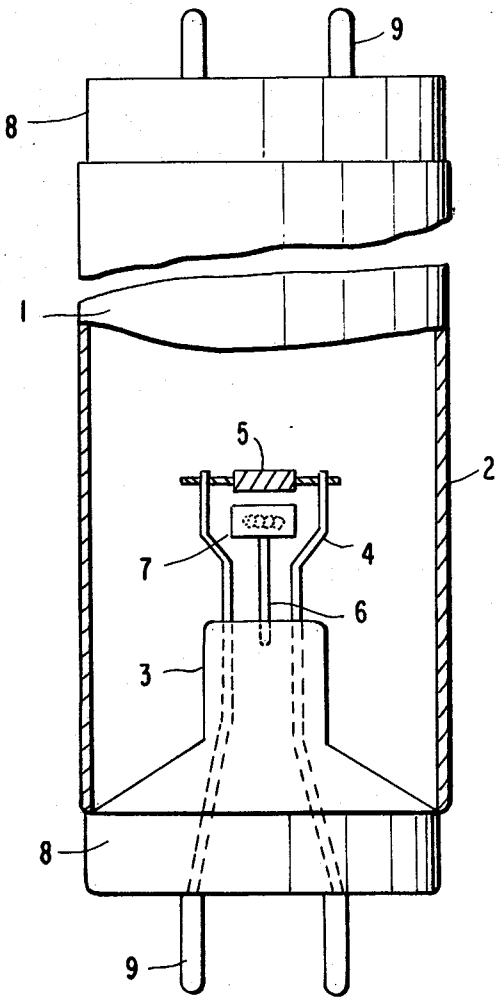
FIG. 5 is a partial cross-sectional view showing another embodiment of a lamp which is applicable to this invention.

A lamp having a getter structure as shown in FIG. 5 is also practicable, which is similar to that in FIG. 4 except for the getter structure and the sealed gas. In FIG. 5 the getter structure 7 has a getter consisting of a zirconium (Zr)—aluminum (Al) alloy attached to an iron plate located near the electrode 5 and clad with nickel. The getter holder holds the iron plate and is directly supported by the stem 3. The lamp contained argon gas at a pressure of 3 Torr. This lamp produced line spectrum with a wavelength ranging from 700 to 900 mm, which is near infrared radiation.

Similar to the embodiment of FIG. 4, such a lamp with no getter has a high starting voltage, a short life and is not practical.

While the lamps with the getter started at a low voltage and lit steadily, those equipped with getter amounts not less than one twentieth near both electrodes performed a steady discharge for a long time; in other words, had a long life.

It was also confirmed that lamps having getters comprising such components as magnesium, titanium, barium, thorium, and vanadium belonging to the third, fourth or fifth periodic group had an effect similar to that described above.

The lamps in the previous two embodiments contained neon or argon as an inert gas while the lamps containing other gases, for example, helium krypton, xenon, or mixed inert gas, which are applicable for specific usages, had a similar effect. A lamp containing hot cathode type of electrode is also applicable.

What is claimed is:

1. A low pressure inert gas discharge device, comprising:

(a) a lamp having a sealed bulb containing inert gas primarily composed of neon at a pressure ranging from 1.5 to 15 Torr, and an electrode structure contained in the bulb, and (b) means for supplying said lamp with electrical power at a frequency of not less than 5 kHz, wherein the peak value Iop (A) of the electrical current and the pressure P (Torr) of the sealed inert gas satisfy the following formulae:

$$\text{when } 1.5 \leqq P \leqq 8,\ Iop \geqq 7/P^{1.1},$$

and $$\text{when } 8 < P \leqq 15,\ Iop \geqq 69/P^{2.2}.$$

2. A device according to claim 1 wherein said inert gas consists of neon.

3. A device according to claim 1, wherein said inert gas comprises neon as a major component and a minor component chosen from the group consisting of argon, krypton and xenon.

4. A device according to claim 3, wherein the amount of neon contained in said gas is not less than 99 percent by volume and the amount of argon, krypton or xenon is not more than 1 percent.

5. A device according to claim 1, wherein said lamp includes getter means, for each electrode, having a metal component chosen from one of the second, third, fourth, or fifth periodic groups, said getter means being disposed such that it does not interfere with electron emissions from said electrode structure.

6. A device according to claim 5, wherein the amount of getter contained in each getter means is not less than one twentieth of that of an electron emitting substance attached to a cathode in each electrode.

7. A device according to claim 5, wherein at least one of said electrodes is a preheating thermionic emission type of electrode.

8. A device according to claim 5, wherein the getter means has a metal component chosen from the group consisting of magnesium (Mg), barium (Ba), titanium (Ti), zirconium (Zr), vanadium (V), and tantalum (Ta).

9. A low pressure inert gas discharge device, comprising:

(a) a lamp having a sealed bulb containing inert gas including neon and argon at a pressure ranging from 1.5 to 8 Torr, and an electrode structure contained in the bulb, and (b) means for supplying said lamp with electrical power at a frequency of not less than 5 kHz, wherein the mixture ratio for argon A (%), the peak value Iop (A) of the electrical current and the pressure P (Torr) of the sealed inert gas satisfy the following formulae:

$$A \leqq 5P^{-2},$$

$$1.5 \leqq P \leqq 8,$$

and $$5.3/P \leqq Iop \leqq 7/P^{1.1}.$$

10. A device according to claim 9, wherein said lamp includes getter means, for each electrode, having a metal component chosen from one of the second, third, fourth, or fifth periodic groups, said getter means being disposed such that it does not interfere with electron emissions from said electrode structure.

11. A device according to claim 9, wherein the amount of getter contained in each getter means is not less than one twentieth of that of an electron emitting substance attached to a cathode in each electrode.

12. A device according to claim 9, wherein at least one of said electrodes is a preheating thermionic emission type of electrode.

13. A device according to claim 9, wherein the getter means has a metal component chosen from the group consisting of magnesium (Mg), barium (Ba), titanium (Ti), zirconium (Zr), vanadium (V), and tantalum (Ta).

14. A low pressure inert gas discharge device, comprising:

(a) a lamp having a sealed bulb containing inert gas including neon and krypton at a pressure ranging from 1.5 to 8 Torr, and an electrode structure contained in the bulb, and (b) means for supplying said lamp with electrical power at a frequency of not less than 5 kHz, wherein the mixture ratio for krypton A (%), the peak value Iop (A) of the electrical current and the pressure P (Torr) of the sealed inert gas satisfy the following formulae:

$$A \leqq 8P^{-2},$$

$$1.5 \leqq P \leqq 8,$$

and $$4.5/P^{0.9} \leqq Iop \leqq 7/P^{1.1}.$$

15. A device according to claim 14, wherein said lamp includes getter means, for each electrode, having a metal component chosen from one of the second, third, fourth, or fifth periodic groups, said getter means being disposed such that it does not interfere with electron emissions from said electrode structure.

16. A device according to claim 14, wherein the amount of getter contained in each getter means is not less than one twentieth of that of an electron emitting substance attached to a cathode in each electrode.

17. A device according to claim 14, wherein at least one of said electrodes is a preheating thermionic emission type of electrode.

18. A device according to claim 14, wherein the getter means has a metal component chosen from the group consisting of magnesium (Mg), barium (Ba), titanium (Ti), zirconium (Zr), vanadium (V), and tantalum (Ta).

19. A method of operating a low pressure inert gas discharge device, comprising the steps of:

(a) charging a sealed lamp envelope with inert gas primarily composed of neon to a pressure ranging from 1.5 to 15 Torr, and (b) supplying electrodes mounted in the lamp with electrical power at a frequency of not less than 5 kHz, wherein the peak value Iop (A) of the electrical current and the pressure P (Torr) of the sealed inert gas satisfy the following formulae:

$$\text{when } 1.5 \leqq P \leqq 8,\ Iop \geqq 7/P^{1.1},$$

and $$\text{when } 8 < P \leqq 15,\ Iop \geqq 69/P^{2.2}.$$

20. A method of operating a low pressure inert gas discharge device, comprising the steps of:

(a) charging a sealed lamp envelope with inert gas including neon and argon to a pressure ranging from 1.5 to 8 Torr, and (b) supplying electrodes mounted in the lamp with electrical power at a frequency of not less than 5 kHz, wherein the mixture ratio of argon A(%), the peak value Iop (A) of the electrical current and the pressure P (Torr) of the sealed inert gas satisfy the following formulae:

$$A \leqq 5P^{-2},$$

$$1.5 \leqq P \leqq 8,$$

and $$5.3/P \leqq Iop \leqq 7/P^{1.1}.$$

21. A method of operating a low pressure inert gas discharge device, comprising the steps of:

(a) charging a sealed lamp envelope with inert gas including neon and krypton to a pressure ranging from 1.5 to 8 Torr, and (b) supplying electrodes mounted in the lamp with electrical power at a frequency of not less than 5 kHz, wherein the mixture ratio for krypton A (%), the peak value Iop (A) of the electrical current and the pressure P (Torr) of the sealed inert gas satisfy the following formulae:

$$A \leqq 8P^{-2},$$

$$1.5 \leqq P \leqq 8,$$

and $$4.5/P^{0.9} \leqq Iop \leqq 7/P^{1.1}.$$

* * * * *